United States Patent [19]

Gulick

[11] Patent Number: 4,516,519

[45] Date of Patent: May 14, 1985

[54] WEDGE DEVICE FOR A PLEASURE BOAT COCKPIT

[75] Inventor: William D. Gulick, Stamford, Conn.

[73] Assignee: S&A Corporation, Rowayton, Conn.

[21] Appl. No.: 476,912

[22] Filed: Mar. 21, 1983

[51] Int. Cl.[3] ..... B63B 35/00

[52] U.S. Cl. ..... 114/270; 182/45; 114/39

[58] Field of Search ..... 114/69, 72–73, 114/75, 76, 85, 65 R, 121, 124, 191, 192, 270, 363, 364, 39; 52/169.4; 105/29 R, 329 R; 14/69.5, 71.1; 182/45; 248/188.2, 148; 297/439, 461; 440/15

[56] References Cited

U.S. PATENT DOCUMENTS

| | | | |
|---|---|---|---|
| 2,748,838 | 6/1956 | Scholl | 297/439 |
| 3,324,815 | 6/1967 | Morales | 114/39 |
| 3,640,240 | 2/1972 | Stein | 440/15 |
| 3,860,284 | 1/1975 | Lichtig | 297/439 |

FOREIGN PATENT DOCUMENTS

| | | | |
|---|---|---|---|
| 898070 | 4/1972 | Canada | 114/69 |
| 52-59485 | 5/1977 | Japan | 114/75 |
| 17233 | of 1900 | United Kingdom | 182/45 |

*Primary Examiner*—Jesûs D. Sotelo
*Attorney, Agent, or Firm*—Bruns & Wall

[57] ABSTRACT

A removable and reversible wedge device adapted to be positioned on the sole of the cockpit of a pleasure boat that is heeling to provide the helmsman with a generally horizontal surface on which to stand. The wedge surface upon which the helmsman stands is preferably curved in the athwartships direction. The lower, sole engaging surface of the wedge device and the upper, support surface for the helmsman are provided with suitable non-slip materials.

4 Claims, 4 Drawing Figures

WEDGE DEVICE FOR A PLEASURE BOAT COCKPIT

BACKGROUND OF THE INVENTION

This invention relates generally to pleasure boats, and has particular reference to a novel wedge device that can be used in a pleasure boat cockpit when the boat is heeling to provide the helmsman with a nearly horizontal surface on which to stand.

As is well known to pleasure boat sailors, and particularly sailboat sailors, standing for any substantial length of time at the helm of a boat that is heeling can be very tiring due to the pitch of the surface on which the helmsman is standing. This happens most often in cruising and/or racing sailboats where the boat may remain on the same tack for a long time and a relatively strong, steady breeze keeps the boat constantly heeled. When this happens, the helmsman standing at the wheel of the boat is quite likely to experience fatigue because of the need for him to brace against the angle of the boat.

While the problem mentioned above is a very long standing one, a practical solution has not previously been devised insofar as the applicant is aware. A preliminary search developed five prior art patents but none is believed to be pertinent to the present invention. These are U.S. Pat. Nos. 2,277,171; 2,617,377; 2,770,286; 3,065,992 and 3,653,715.

SUMMARY OF THE INVENTION

The invention contemplates a removable and reversible wedge device that is adapted to be positioned on the sole of the cockpit of a pleasure boat that is heeling to provide the helmsman with a generally horizontal surface on which to stand. In a preferred embodiment of the invention, the wedge surface upon which the helmsman stands is curved in the athwartships direction and this operates to provide him with a support surface that is generally perpendicular to the line of gravitational force through his body. The result is that the helmsman can perform his task in a safer, more comfortable position.

The lower, sole engaging surface of the wedge device and the upper, support surface for the helmsman are provided with suitable non-slip means. In one embodiment of the device, the non-slip means for the upper surface is a ribbed rubber mat that is received in a recess in the upper surface.

DESCRIPTION OF THE PREFERRED EMBODIMENT

Figure 3:
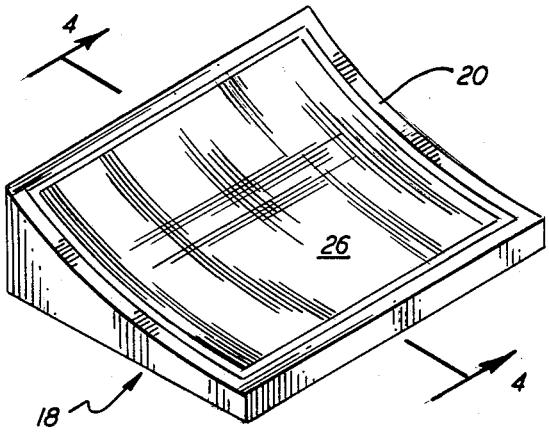
FIG. 3 is an enlarged perspective view of the wedge device.
Figure 1:
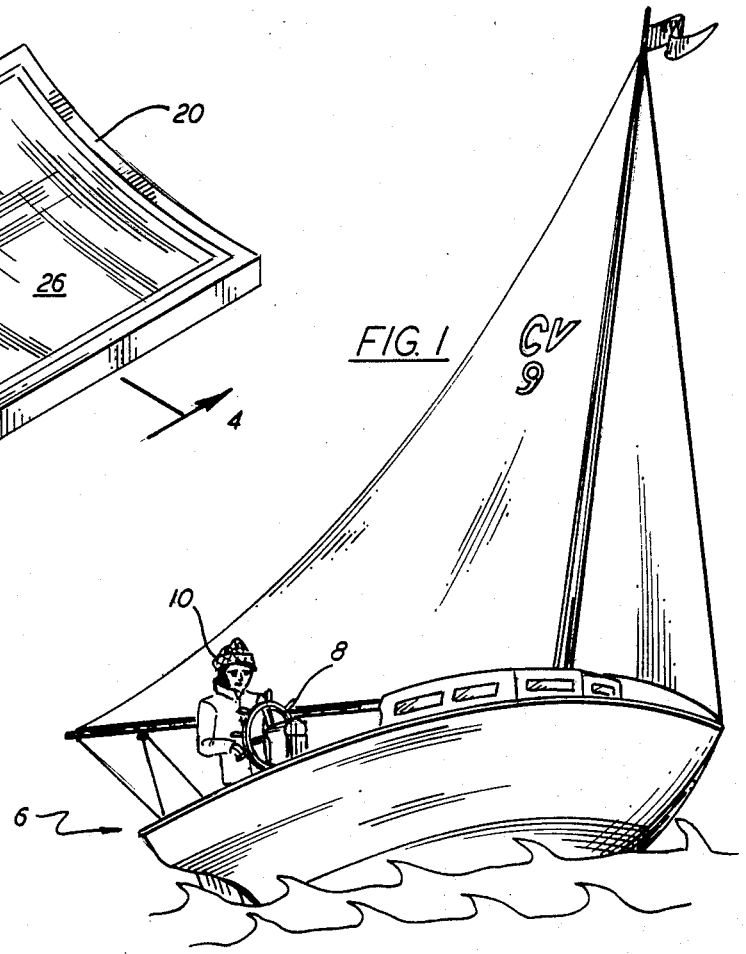
FIG. 1 is a perspective view of a heeling sailboat in which the wedge device of the invention can be utilized to help the helmsman combat fatigue.
Figure 2:
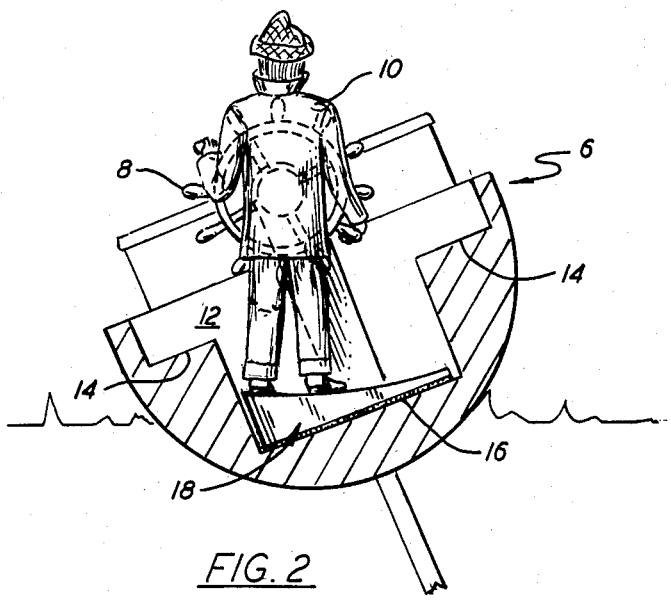
FIG. 2 is a diagrammatic transverse section through the hull of a heeling boat showing the wedge device in use.

Having reference now to the drawings, the heeling sailboat 6 of FIGS. 1 and 2 illustrates a typical sailing posture in which the wedge device of the invention can be advantageously used. If the boat is equipped with a wheel 8, the helmsman 10 will normally stand behind the wheel, as shown, to steer the boat. As best seen from FIG. 2, the boat typically has a cockpit 12 provided with seats 14, the bottom or sole of the cockpit being indicated at 16.

Without the wedge device of the invention, to be described, it will be apparent from FIG. 2 that when the boat 6 is heeling the cockpit sole 16 has enough pitch so that standing on it for any length of time can be very tiring. To alleviate this, the invention contemplates the provision of a wedge device generally indicated at 18. The wedge device has a large enough upper surface 20 so that the helmsman can stand on it comfortably but it is also light enough so that it can be easily removed if not needed. Because the wedge device 18 is not attached to the boat, it can easily be rotated 180° to reverse its position when the boat is heeling in the opposite direction from that shown in FIG. 2.

In its preferred form, the upper surface 20 of the wedge device is curved in the athwartships direction, the radius of curvature being approximately 3′ or one half the height of a 6′ man. This curvature operates to provide the helmsman with a support surface that is generally perpendicular to the line of gravitational force through his body as indicated in FIG. 2.

Figure 4:
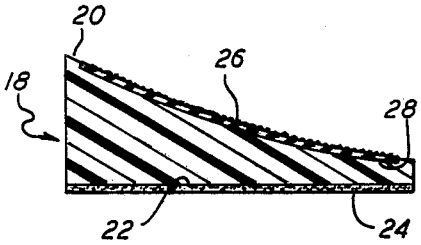
FIG. 4 is a vertical sectional view of the device taken on line 4—4 of FIG. 3.

Because the sole 16 of the cockpit may be wet and slippery, the bottom or sole engaging surface 22 of the wedge device is preferably provided with a layer 24 of non-slip material as shown in FIG. 4. For the same reason, the upper surface 20 of the device is also provided with some type of non-slip surface which, in the embodiment shown, is a ribbed or corrugated rubber mat 26 that is secured in a recess 28 in the upper surface. The body of the wedge device can be made of a suitable plastic as indicated in FIG. 4 or, alternatively, it can be formed of wood.

While the invention has been described with reference to a helmsman standing at a ship's wheel, it will be understood by those familiar with small boat sailing that the wedge device 18 can also be used advantageously with a boat equipped with a tiller. Thus, there are many occasions when a helmsman will prefer to stand rather than to sit while holding the tiller.

From the foregoing description it will be apparent that the invention provides a novel auxiliary device for a pleasure boat which device enables the boat's helmsman to perform his task in a less tiring, more comfortable manner than has heretofore been possible. As will be apparent to those familiar with the art, the invention may be embodied in other specific forms without departing from the spirit or essential characteristics thereof.

I claim:

1. For use in a sailboat having a cockpit and a helm located in or extending into the cockpit, means provided so a helmsman can stand aproximately vertical regardless of the amount of boat heeling including: a removable and reversible wedge device having a lower surface adapted to be positioned on the upper surface of the sole of the cockpit, non-slip means on said wedge lower surface, the wedge device providing a generally horizontal upper surface when the boat is heeling for the helmsman of the boat to stand upon whereby the fatigue that a helmsman normally experiences due to the heeling is minimized, non-slip means on said upper surface, and the upper surface of said wedge being curved in the athwartships direction.

2. A wedge device as defined in claim 1 wherein the upper surface is recessed and the non-slip means is a resilient, corrugated sheet positioned in the recess.

3. A wedge device as defined in claim 1 wherein the device is formed of wood.

4. A wedge device as defined in claim 1 wherein the device is a unitary member formed of plastic.

* * * * *